United States Patent [19]

Sanders et al.

[11] 4,240,360

[45] Dec. 23, 1980

[54] STACKABLE FLAT PALLET

[76] Inventors: Heinz Sanders; Horst Langmann, both of Böhmerstrasse 2, D-5800 Hagen, Fed. Rep. of Germany

[21] Appl. No.: 922,727

[22] Filed: Jul. 7, 1978

[30] Foreign Application Priority Data

Jul. 8, 1977 [DE] Fed. Rep. of Germany ..... 2730879

[51] Int. Cl.[3] ..... B65D 19/28

[52] U.S. Cl. ..... 108/53.3; 108/51.1

[58] Field of Search ..... 108/53.3, 53.1, 51.1, 108/57.1, 56.1, 52.1, 53.5, 55.1, 901, 902; 206/386, 598, 599

[56] References Cited

U.S. PATENT DOCUMENTS

| | | | |
|---|---|---|---|
| 1,934,389 | 11/1933 | Ulsh | 108/53.3 |
| 2,542,129 | 2/1951 | Fletcher | 108/57.1 |
| 2,762,593 | 9/1956 | Weiss | 108/57.1 |
| 3,172,374 | 3/1965 | Allen | 108/51.1 |
| 3,227,108 | 1/1966 | Greaves | 108/53.3 |
| 3,277,849 | 10/1966 | Talbot | 108/53.3 |
| 3,342,146 | 9/1967 | Lessheim | 108/53.3 |
| 3,557,441 | 1/1971 | Boik et al. | 29/509 |
| 3,702,100 | 11/1972 | Wharton | 108/53.3 |
| 3,731,369 | 5/1973 | Johnson | 29/509 |
| 3,762,344 | 10/1973 | Chez | 108/51.1 |

FOREIGN PATENT DOCUMENTS

| | | | |
|---|---|---|---|
| 2333811 | 3/1974 | Fed. Rep. of Germany | 108/51.1 |
| 2430889 | 8/1976 | Fed. Rep. of Germany . | |
| 1241565 | 8/1960 | France | 108/51.1 |
| 399319 | 3/1966 | Switzerland | 108/51.1 |

*Primary Examiner*—William E. Lyddane

*Attorney, Agent, or Firm*—Spencer & Kaye

[57] ABSTRACT

A flat pallet including a supporting deck, sheet metal supporting feet connected to the deck, each of the supporting feet having a tapered, skid-like configuration, and horizontal flanges connected to the feet, and fastened to the deck, with the supporting feet and flanges together being constituted by a plurality of uniform, shaped sheet metal strips.

12 Claims, 29 Drawing Figures

STACKABLE FLAT PALLET

BACKGROUND OF THE INVENTION

The present invention relates to a stackable flat pallet of the type which is composed of a supporting deck and supporting feet of sheet metal and in which the supporting deck is provided with openings that are adapted to the supporting fee and with corrugations distribution over the sheet metal as well as with a crimped edge, and the supporting feet are designed as tapered, runner-like structures which are provided with horizontal flanges resting against the supporting deck and fastened thereto.

Stackable, flat pallets of sheet metal must occupy a minimum space, be easily stackable and stable, should be manufacturable in a simple manner from as little material as possible, i.e. utilizing sheets that are as thin as possible and, in particular, their supporting feet should be attachable in a simple manner.

A stackable flat pallet disclosed in German Pat. No. 2,430,889 has a sheet metal supporting deck provided with rectangular openings having edges in the form of deep-drawn zones, and supporting feet which are produced individually. The horizontal flanges of the feet are fastened to the deep-drawn edges of the openings and, in the immediate vicinity of the edges, to the supporting deck. For fastening the feet, the flanges of each supporting foot are provided with bores into which material stamped out of the supporting deck is pushed and crimped to form a type of rivet. Longitudinally oriented corrugations are provided at the supporting feet. During stacking, the supporting feet pass through the openings of the supporting deck disposed therebelow.

As is disclosed in U.S. Pat. No. 3,172,374, it is also known to use one-piece runners on a nonstackable pallet whose supporting deck has no openings, the supporting runners having a cross section in the form of a W.

SUMMARY OF THE INVENTION

It is an object of the present invention to improve stackable flat pallets of the above-mentioned type so that their manufacture is simplified and their stability is improved even if no deep-drawn zones are provided in the region of the openings so that it is not possible to fasten the flanges of the supporting feet in two planes.

These and other objects are achieved according to the invention essentially by the particular arrangement of a uniformly shaped sheet metal strip as a row of supporting feet of a stackable flat pallet. During manufacture of such a flat pallet, there appear significant advantages from a production technology point of view. For example, instead of producing nine individual parts for a pallet which is generally provided with nine supporting feet, only three sheet metal strips need be produced, shaped, supplied and attached. Moreover, each one of the shaped, continuous sheet metal strips gives the finished flat pallet greater stability. The quantity of material used remains small. The material employed and its shaping assure great wear resistance and stability in the finished flat pallet. The advantages of a flat pallet which does not absorb moisture and can be cleaned with each are retained.

DESCRIPTION OF THE PREFERRED EMBODIMENTS

Figure 16:
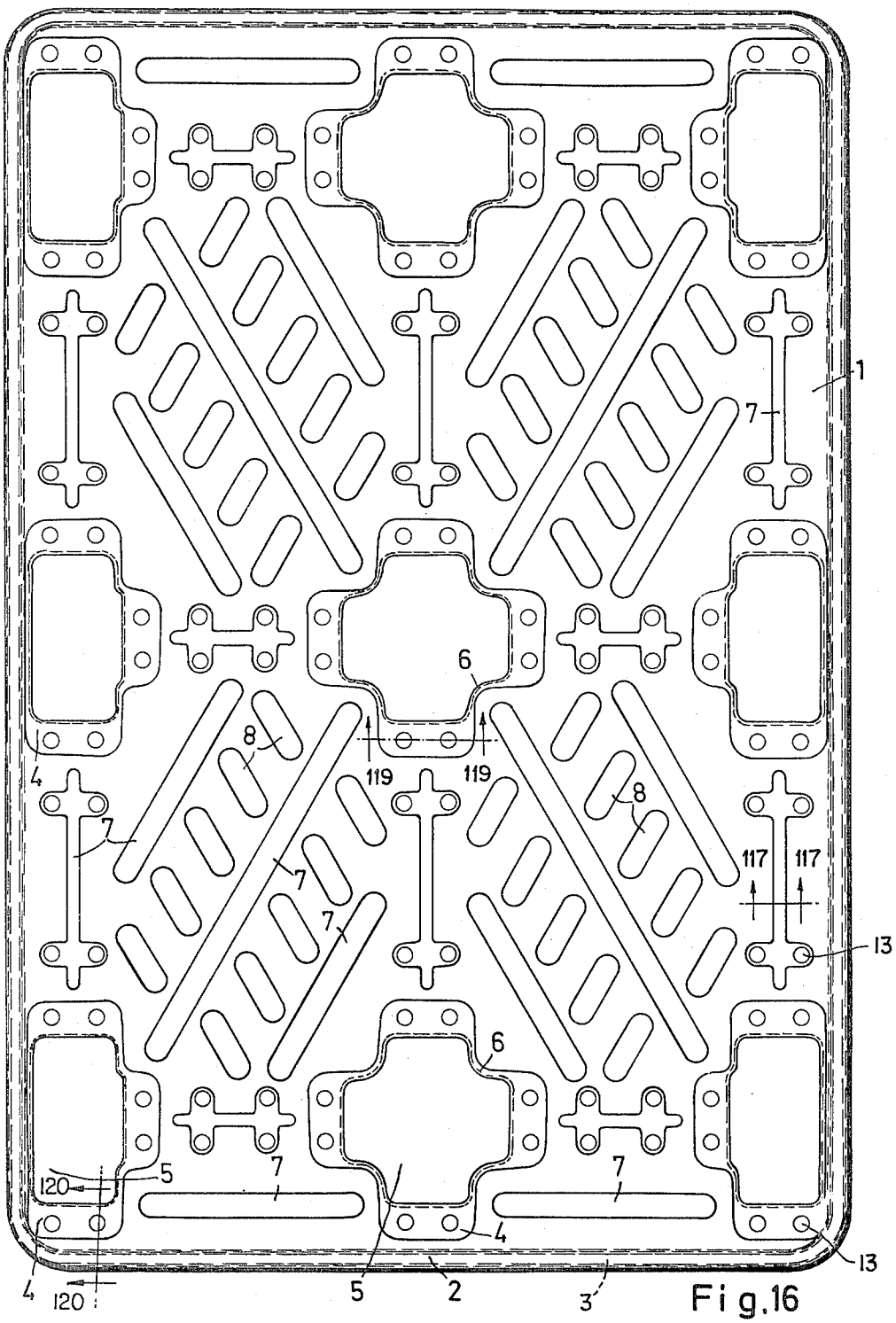
FIG. 16 is a plan view of a supporting deck for a pallet according to a further preferred embodiment of the invention.
Figure 20:
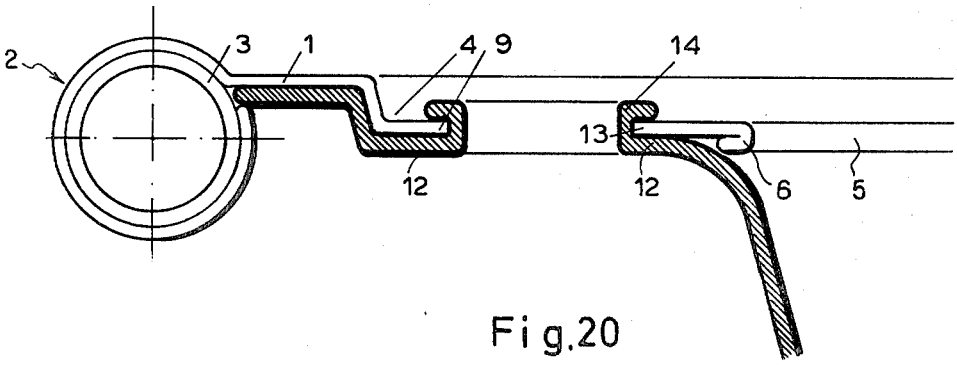
FIG. 20 is a cross-sectional, detail view taken along line 120—120 of FIG. 16.
Figure 28:
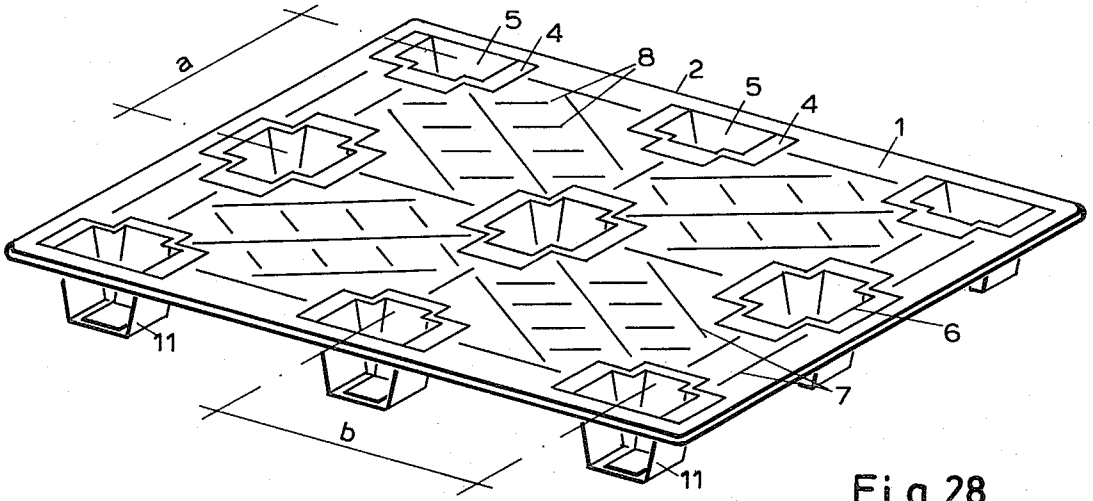
FIG. 28 is a top perspective view of a preferred embodiment of a pallet according to the invention provided with the supporting deck shown in FIG. 16.

Referring first to the flat pallet shown in FIG. 28, this includes a rectangular supporting deck 1 of sheet metal having the form shown in FIG. 16. The entire edge 2 of the supporting deck 1 is crimped, or folded over in a manner shown in FIG. 20, and houses an insertable stiffening frame 3, preferably of metal wire, like that shown in FIGS. 11 and 12. At given intervals a and b along its width and length, respectively, the supporting deck 1 is provided with deep-drawn zones 4. One of these deep-drawn zones 4 is disposed at each corner of the supporting deck 1. A further deep-drawn zone is disposed in the center between each two corner deep-drawn zones 4 along the long as well as the short sides of the supporting deck 1. The last deep-drawn zone 4 is disposed at the center of gravity of the supporting deck 1. Each deep-drawn zone forms a dish. An opening 5 is provided in each one of the deep-drawn zones 4. In the center longitudinal row, these openings 5 have the shape of a cross, in each outer longitudinal row they have the shape of a T whose short leg is directed inwardly. Each edge 6 of each opening 5 is crimped, or folded over as shown in FIG. 20.

At least one longitudinal corrugation 7 is provided between each two deep-drawn zones 4 in supprting deck 1 as shown in particular in FIG. 16. Starting with the deep-drawn zone at the center of gravity of the supporting deck 1, diagonal corrugations 7 extend toward the corners of the deck. Parallel to each such corrugation there are two further longitudinal corrugations 7 which, however, are somewhat shorter than their associated center corrugation. The spaces between these longitudinal corrugations 7 are filled by transverse corrugations 8. Such an arrangement of corrugations has the result of assuring an optimum load distribution no matter from which direction a lifting fork enters.

Figure 4:
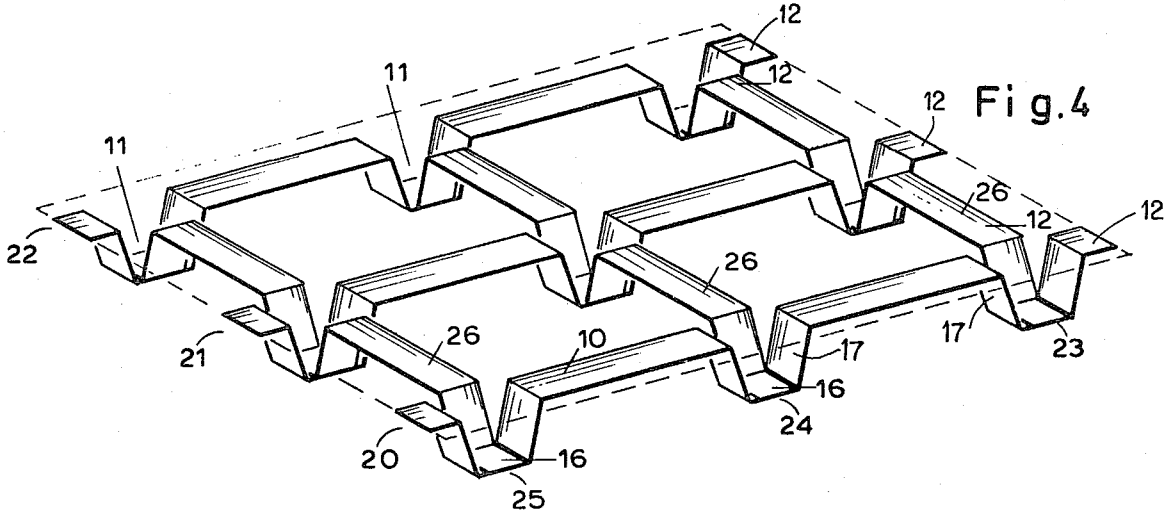

A supporting foot in the form of a runner is fastened below the supporting deck 1 in the area of each opening 5. As shown in FIG. 4, the supporting feet 11 are constituted by longitudinally extending, uniform, identical shaped sheet metal strips 10 and transversely extending, uniform, identical shaped metal strips 26. Strips 10 are identical to the embodiment shown in FIG. 1. The configuration of these sheet metal strips 10 and 26 and of the other sheet metal strips which can be used in the flat pallet will be described in detail below.

The width of each supporting foot 11 is somewhat less than the width, in direction a, of openings 5. At each of its free ends, each strip 10 is angled to form an outer flange 12 and this flange is bent to conform to the outer part of an associated deep-drawn zone 4, as shown in detail in FIG. 20. Each outer flange 12 of strips 10 thus rests against the outer edge 9 of the zone 4 as well as, in the immediate vicinity of the zone edge 9, against the more elevated planar portion of supporting deck 1. The outer flanges 12 of each strip 10 are fastened to the zone edges 9 as well as, in the immediate vicinity of the zone edges 9, to the planar region of the supporting deck 1.

Strips 10 and 26 additionally present inner flanges 12 between adjacent feet and the flanges 12 of each strip are provided with small bores, the material 14 bordering these bores being pushed through larger bores 13 in the supporting deck 1 and being crimped in the manner of a rivet. The resulting connection can have one of the forms shown in FIGS. 20, 21 and 22.

The bores in flanges 12 can be stamped in and can have, for example, a diameter of about 8 mm. Concentric therewith, bores 13 in deck 1 can have a diameter of about 18 mm. The material surrounding the bores in flanges 12 is drawn or pressed through the larger bores 13 in deck 1 and is then folded over, as by swaging, at the top side of the supporting deck 1. These fastenings between the strips and supporting deck 1 are made at laterally offset locations so as to distribute the stress on the material over several axes. The exact bore diameters in the strips and in the supporting deck 1 depend on the material thicknesses employed. Since the stronger material is pushed through the weaker material the resulting effect is a maximum with respect to stability and neatness. In this configuration, no additional material for fastening is required, in particular no rivets, screws or weld connections.

Figure 17:
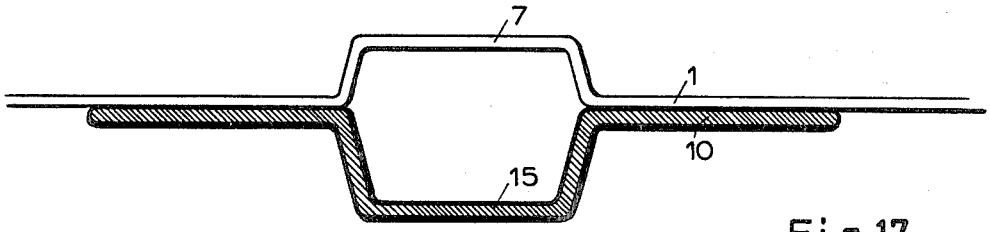
FIG. 17 is a cross-sectional, detail view taken along line 117—117 of FIG. 16.
Figure 18:
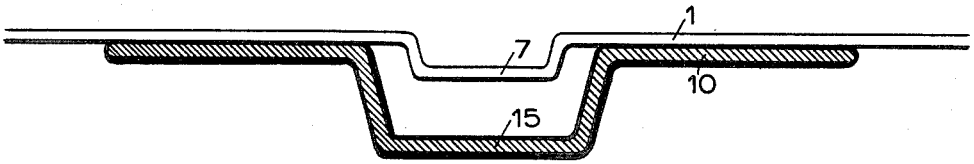
FIG. 18 is a cross-sectional detail view similar to that of FIG. 17 showing a modification of the configuration shown in FIG. 17.
Figure 19:
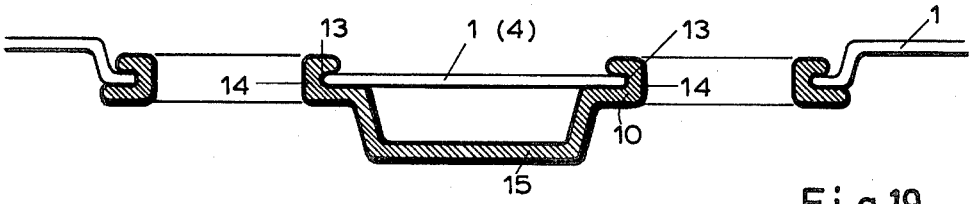
FIG. 19 is a cross-sectional, detail view taken along line 119—119 of FIG. 16.

Each sheet metal strip 10 is provided with a longitudinal corrugation 15, shown only in FIGS. 17, 18 and 19. The longitudinal corrugation 15 of each strip extends in the areas 16 where the supporting feet 11 stand on the ground and along the sloping sides 17 of each foot to be continued at the end of flanges 12. In other words, a corrugation 15 extends along the entire length of each strip 10. When strips 10 are assembled with deck 1, the longitudinal corrugation 15 of each strip lies in the same plane with one row of the longitudinal corrugations 7 of the supporting deck 1.

The longitudinal corrugations 15 in the sheet metal strips 10 are convex in the direction toward the standing areas 16 of the supporting feet, i.e. are downwardly convex, while the longitudinal corrugations 7 in the supporting deck 1 are preferably upwardly convex, i.e. convex in the direction of the load they will support, as shown in FIG. 17. In this embodiment, there is produced a so-called pipe and box relation: the corrugations of the supporting deck and those of the sheet metal strips face one another in the manner of a pipe or box, which results in particularly good stability. Where such design is not possible, the corrugation in the supporting deck may be made convex in the direction of the corrugation in the sheet metal strip, as shown in FIG. 18.

In the described flat pallet, the supporting feet can be of the type shown in FIGS. 1 through 5. In the embodiment shown in FIG. 1, the supporting feet 11 are defined by three identical sheet metal strips 10 extending parallel to the long dimension of deck 1. Thus, each strip 1 presents a respective longitudinal row 20, 21 or 22 of supporting feet. Each sheet metal strip 10 has interior and end flanges 12. Each outer flange 12 may be wrapped around the insertable frame 3 along the edge 2 in the manner shown in FIGS. 11 and 12.

Figure 2:
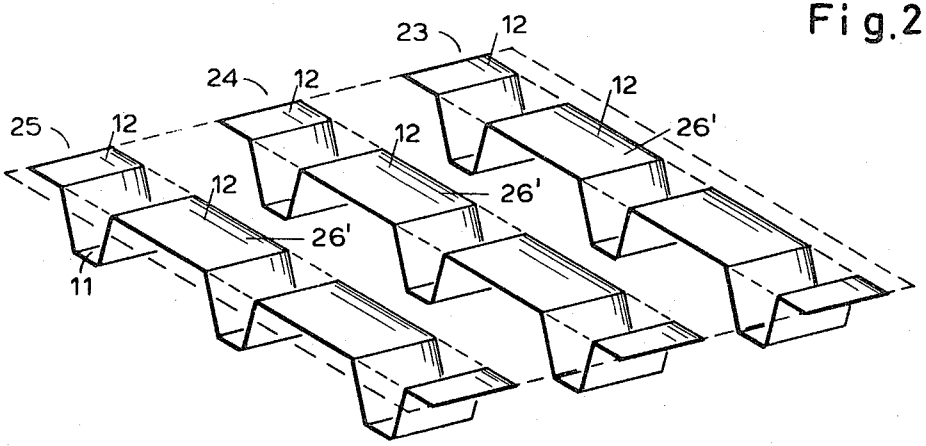
FIGS. 2–10 are views similar to that of FIG. 1 of further embodiments of supporting feed arrangements for pallets according to the invention.

FIG. 2 shows analogously constructed and arranged sheet metal strips 26'. However, here the strips extend parallel to the narrow side of the pallet in transverse rows 23, 24, 25 and are wider than strips 10 to present longer standing surfaces for the supporting feet. This makes the pallet fully usable on a roller conveyor and storable in conventional pallet racks.

Figure 1:
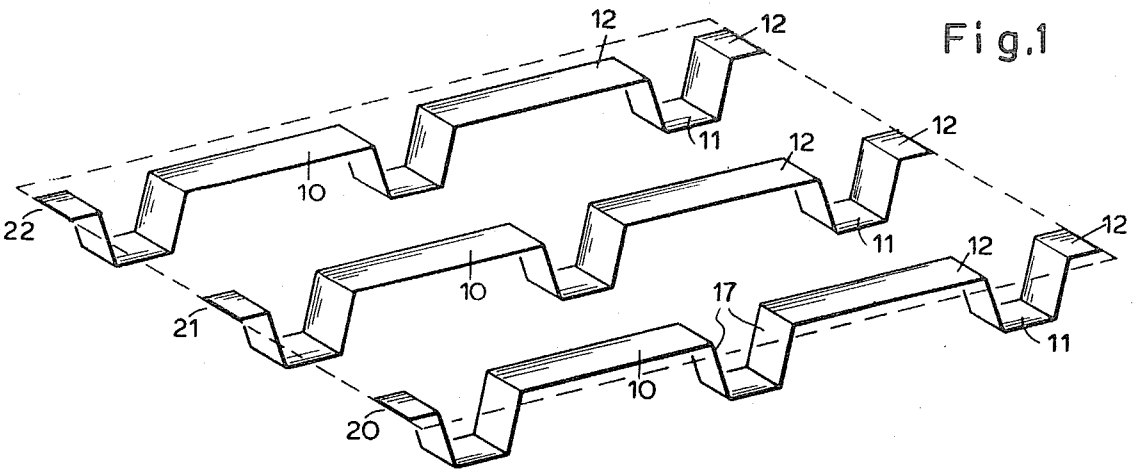
FIG. 1 is a top perspective view of one embodiment of an arrangement of supporting feet for a pallet according to the invention.
Figure 3:
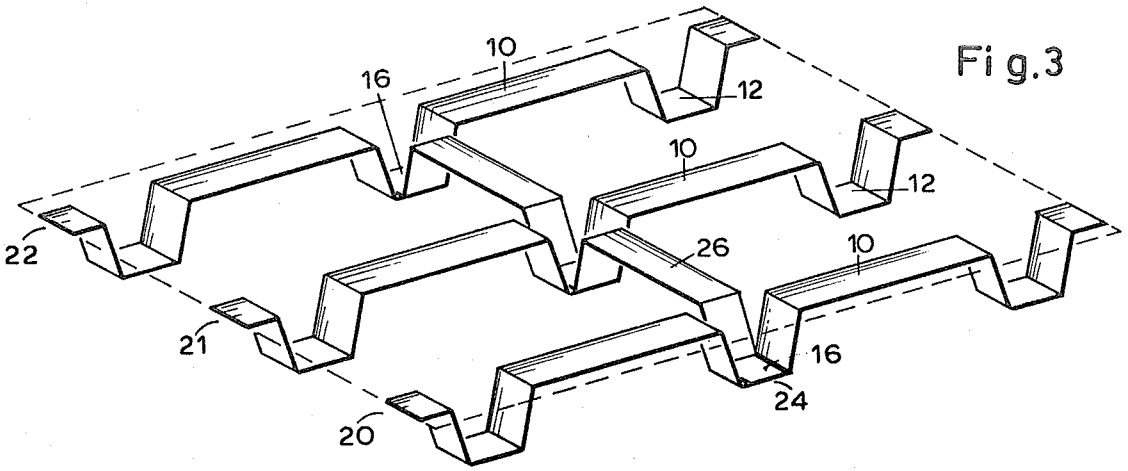

The embodiment shown in FIG. 3 is identical to that of FIG. 1 to which is added to an additional uniformly shaped metal strip 26 forming part of the center transverse row 24 of feet and crossing with the sheet metal strips 10 of the longitudinal rows 20, 21 ane 22. The portions of sheet metal strip 26 contributing to forming the outer supporting feet 11 in the center transverse row 24 end in the corresponding standing areas 16.

Figure 23:
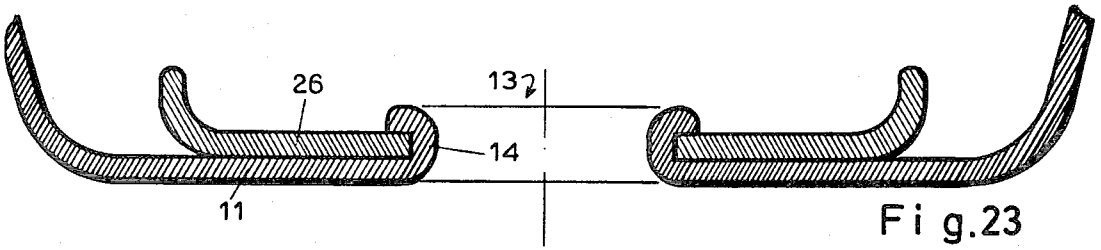

The transverse strips 26 are fastened to the longitudinal stripes 10 at the location of supporting feet 11 in a way shown in FIG. 23.

In the embodiment shown in FIG. 4, not only the supporting feet 11 arranged in the center transverse row 24 but also the supporting feet 11 arranged in the outer transverse rows 23 and 25 are formed in part by additional shaped sheet metal strips 26. The sheet metal strips 10 in the longitudinal rows 20, 21, 22 and the sheet metal strips 26 in transverse rows 23, 24, 25 cross at the locations of supporting feet 11. The parts of sheet metal strips 26 in transverse rows 23, 24, 25 which contribute to forming the outer supporting feet 11 end in the corresponding standing area 16 and these strips are provided only with inner flanges 12 between feet 11. Thus, supporting feet along the center longitudinal row 21 are closed on all four sides by strip material, while the feet in rows 20 and 22 are closed on only three sides.

Figure 5:
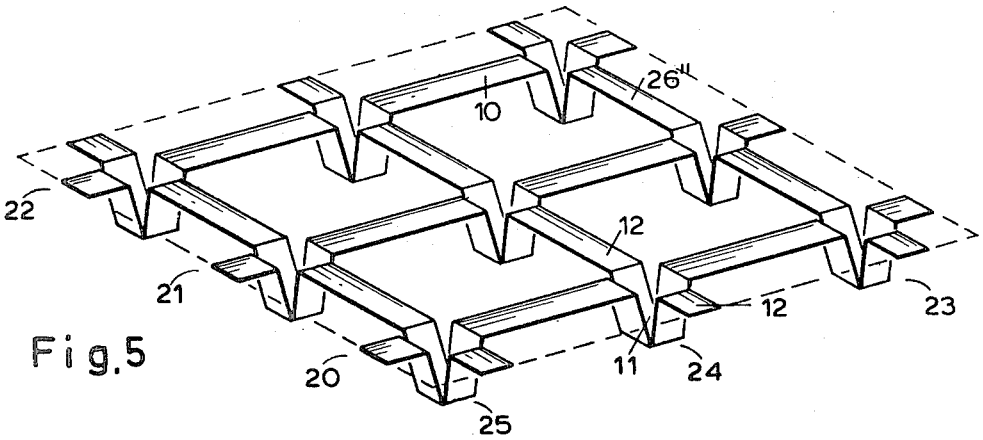

In the embodiment shown in FIG. 5 as well, the sheet metal strips 10 in longitudinal rows 20, 21 and 22 are crossed by sheet metal strips 26'' of transverse rows 23, 24 and 25, the two sets of strips intersecting at the locations of the supporting feet 11. In this embodiment, however, transverse strips 26'' are also provided with outer flanges 12, so that all supporting feet are closed on all four sides by strip material.

The previouly described longitudinal corrugations 15 may be provided in all sheet metal strips of the above-described embodiments. The sheet metal strips 10 and 26 may also be angled in the area of the supporting feet 11 for cases where the openings 5 are provided in the form of deep-drawn zones 4 of the type shown in FIG. 28. The use of crossed sheet metal strips for the supporting feet permits manufacture of the supporting deck of extremely thin sheet metal, since the supporting deck is extremely well stiffened in all directions.

Figure 11:
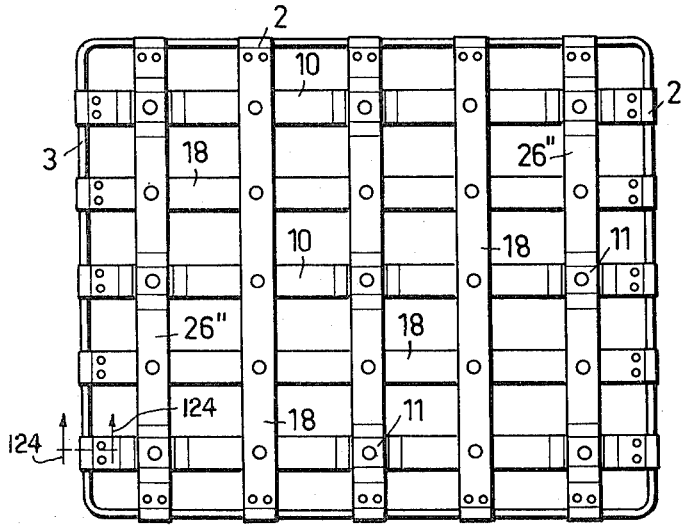
FIG. 11 is a plan view of one preferred embodiment of a pallet according to the invention.
Figure 12:
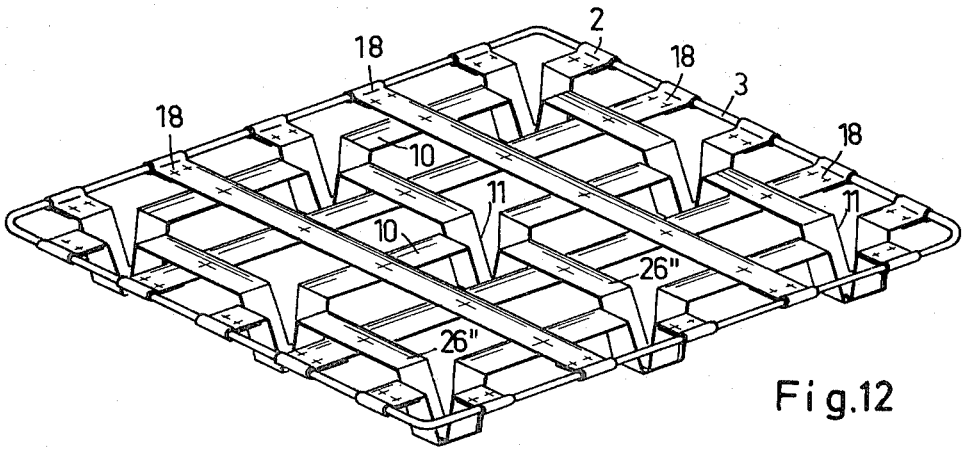
FIG. 12 is a top perspective view of the pallet of FIG. 11.
Figure 21:
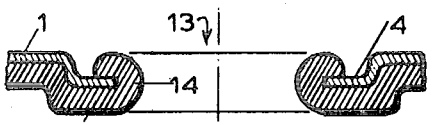
FIGS. 21–23 are cross-sectional, detail views illustrating pull-through connections at various points of a pallet according to the invention.
Figure 22:
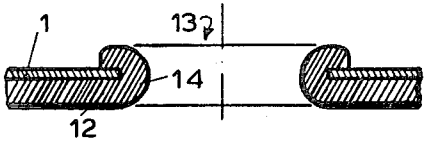
Figure 24:
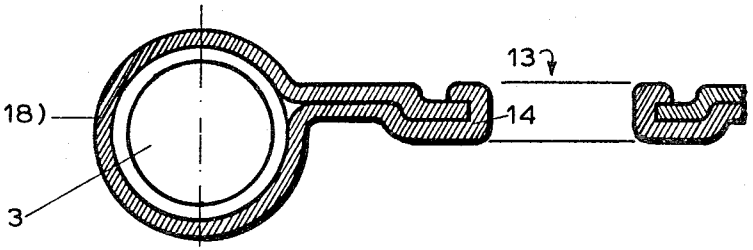
FIG. 24 is a cross-sectional, detail view taken along line 124—124 of FIG. 11.

In the flat pallet shown in FIGS. 11 and 12, which employs arrangement of supporting feet shown in FIG. 5, the supporting deck is made of planar sheet metal strip 18 , the flanges 12 of sheet metal strips 10 and 26'' providing the supporting feet 11, and a closed, tubular frame 3. These sheet metal strips 10, 26'' form the respective outermost strips and the center strip in the longitudinal direction as well as in the transverse direction. Between each two parallel sheet metal strips 10, 26'' there is provided a respective one of the planar sheet metal strips 18. Along the edge 2, the outer flanges at the ends of all sheet metal strips 10, 18, 26 are wrapped around the insertable tubular frame 3 in a manner to conform to the outline of the frame, and to firmly engage the frame, as shown in FIG. 24. At the points where two strips cross, whether in a standing area 16 or at the level of the deck, they are connected together. Similar connections are provided in the region where each outer flange is wrapped around frame 3. The points of connection are represented by holes in FIG. 11 and crosses in FIG. 12. The connections may have the rivet-like form described earlier herein in connection with fastening of the supporting feet 11 to the supporting deck 1. FIGS. 21 and 22 show examples of such connections at points where two strips cross at the level of the deck, FIG. 23 shows an example of the connection in a standing area 16, i.e. at the base of a foot 11, and FIG. 24 shows such a connection at an outer flange adjacent frame 3.

For certain loads, e.g. beverage cases, the strips are arranged at distances and widths such that the goods find a sufficient supporting surface and are held in position by special deformations on the deck surface. Together with a further tubular frame, such a pallet can also be made into a double-decker pallet. Sheet metal strips 10, 18 and 26 may be provided with longitudinal stabilizing corrugations 15.

The above-described flat pallets can be produced of sheet metal, particularly zinc-plated, stainless, lacquered and/or coated steel sheets or aluminum sheets. The dimensions of the flat pallets between adjacent feet which determine the available fork-insertion width and the insertion height meet the requirements for four-way pallets as defined in DIN [German Industrial Standards] 15 141. With outer dimensions and load bearing capability as defined in DIN 15 146, Sheet 2, the weight of a pallet according to the invention is 50% and more below the permissible weight.

Figure 29:
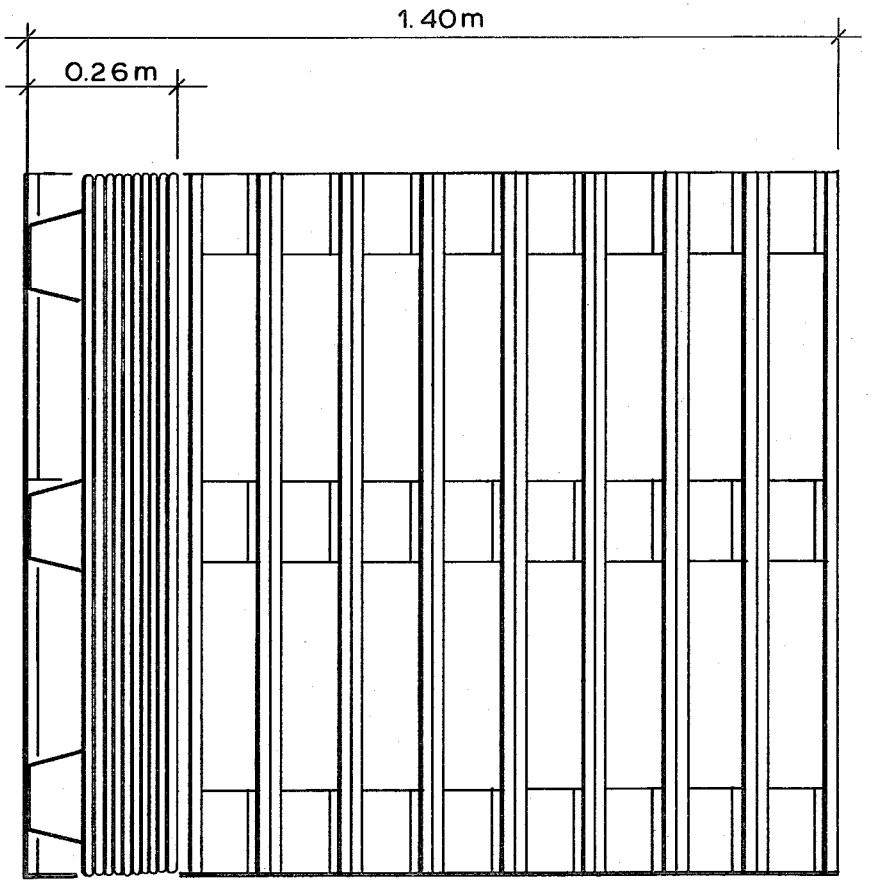
FIG. 29 is a schematic elevational view showing the relative stacking capabilities of pallets according to the invention.

When two or more flat pallets are stacked in alignment with one another, the edges 2 rest one on top of the other. The supporting feet 11 of one pallet pass through the openings 5 (FIGS. 16 and 28) of the pallet therebelow into the cavities formed by the supporting feet 11 of the latter. The edge 2 of the supporting deck 1 is given a thickness, the slope of the sides 17 of the supporting feet 11 are given an angle, and the thickness of the corrugations 7, 8 and 15 are selected, such that adjacent, stacked pallets come to rest against one another via their edges 2 without the supporting feet 11 of adjacent pallets contacting. The height of such a stack of a number of pallets is then, with an assumed distance of 100 mm between the level of standing areas 16 and the lower edge of supporting deck 1, equal to 100 mm added to the product of the number of pallets multipled by the edge thickness of the supporting deck of each. The savings in space can be seen in FIG. 29 which shows 10 pallets according to the invention, forming a stack 0.26 m in height, next to 10 identically dimensioned nonstackable pallets forming a stack 1.4 m in height.

When smaller loads are involved, it is possible to use thinner material and/or to employ a pallet having less than nine supporting feet.

Figure 6:
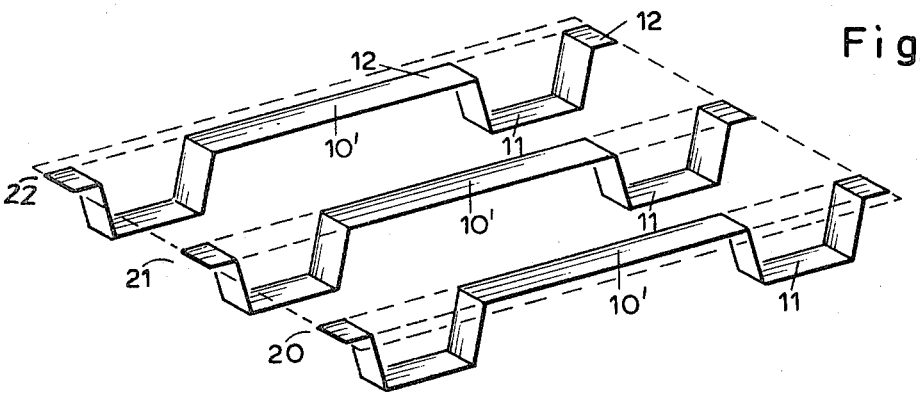
Figure 7:
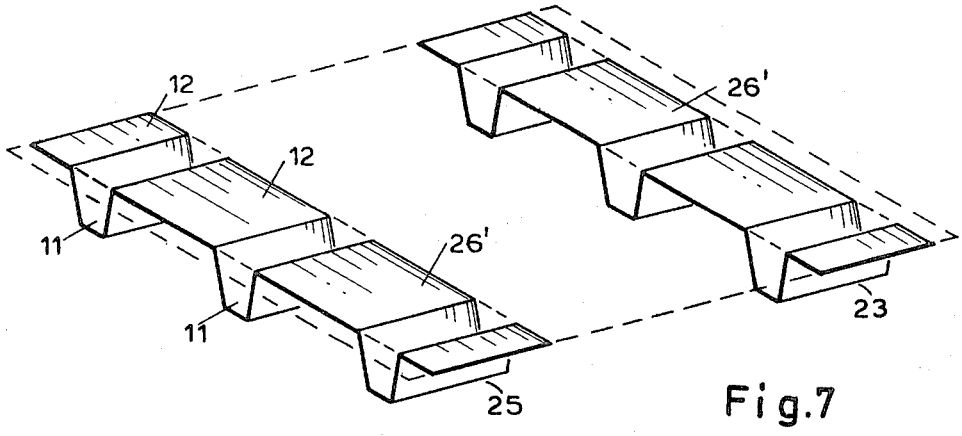

In the embodiment of a sheet metal strip arrangement shown in FIG. 6 which otherwise is analogous to that of FIG. 1, three longitudinal strips 10'' presenting only six supporting feet 11 are provided. In the embodiment of FIG. 7, otherwise analogous to FIG. 2, two transverse strips 26' presenting six supporting feet 11 are provided.

Figure 8:
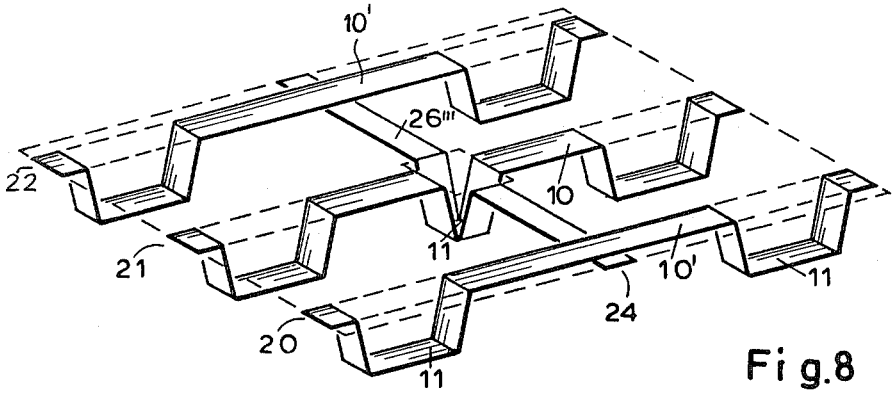

In the embodiment shown in FIG. 8, the longitudinal rows 20, 21 and 22 are each constituted by a sheet metal strip 10 or 10', of which the strips 10' in the outer longitudinal rows 20 and 22 have supporting feet 11 only at their ends, the strip 10 in the center longitudinal row 21 additionally having a supporting foot 11 at the center. Additionally, the center transverse row 24 is provided with a sheet metal strip 26''' which is bent in the center to form part of the supporting foot 11, while the free ends pass underneath the sheet metal strips 10' of the longitudinal rows 20 and 22. Such a pallet has six supporting feet 11 in the longitudinal rows and, in order to stabilize the pallet in its center of gravity, a center supporting foot 11 in the form of a supporting foot that is closed by sheet metal on all four sides. In this embodiment the sheet metal strip 26''' of the center transverse row 24 crosses the sheet metal strip 10 in the region of central foot 11 and crosses strips 10' in regions between feet.

Figure 9:
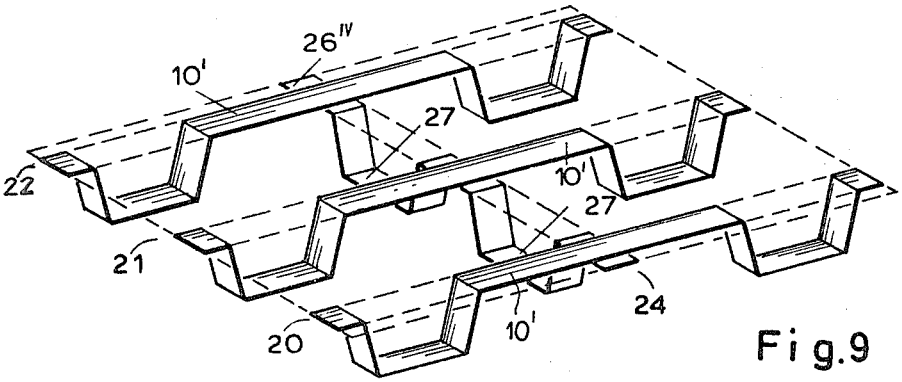

In the embodiment shown in FIG. 9, a sheet metal strip $26^{IV}$ at the location of center transverse row 24 crosses the sheet metal strips 10' of the longitudinal rows 20, 21 and 22 only in regions between supporting feet, i.e. at the level of the pallet deck. In this case, in addition to the three supporting feet 11 in each of longitudinal rows 20, 21 and 22, two supporting feet 27 are provided in transverse row 24, each foot 27 being positioned between one of the outer longitudinal rows 20 and 22 and the center longitudinal row 21. These supporting feet 27 likewise stabilize the pallet. They must be broad enough that the forks of a fork-lift stacker or of a suspended fork conveyor can safely slide under the supporting deck 1 of the flat pallet and through the supporting feet 27, as described above for a four-way pallet.

Figure 10:
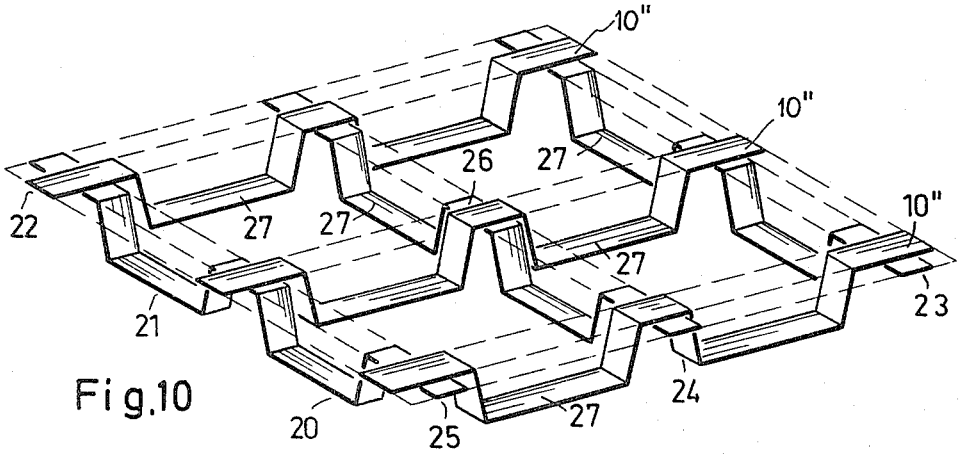

Finally, in the embodiment shown in FIG. 10, the supporting feet in sheet metal strips 10'' forming the longitudinal rows 20, 21 and 22 are also designed as broad supporting feet 27, each strip having two such feet. This embodiment approxinates an upside-down version of the arrangement shown in FIG. 4, if the strips 10 of FIG. 4 were not provided with outer flanges. Pallets of this type can be transported on a conveyor in any direction. Due to their large contact areas, pallets employing the above described arrangements of supporting feet and loaded with suitable goods can be stacked on top of one another. Instead of a supporting deck, such a pallet can also be provided with supporting strips 18, as shown in FIGS. 11 and 12, which are preferably associated with the arrangements of FIGS. 6–10 by being arranged in a diagonal orientation.

The bores 13 provided for fastening the supporting metal strips defining supporting feet to the supporting deck 1 may be designed so that they are suitable for the engagement of the fastening elements of stacking bars. Moreover, the supporting feet 11 may be provided with devices suitable for clipping on futher members, e.g. carrying frames.

Figure 13:
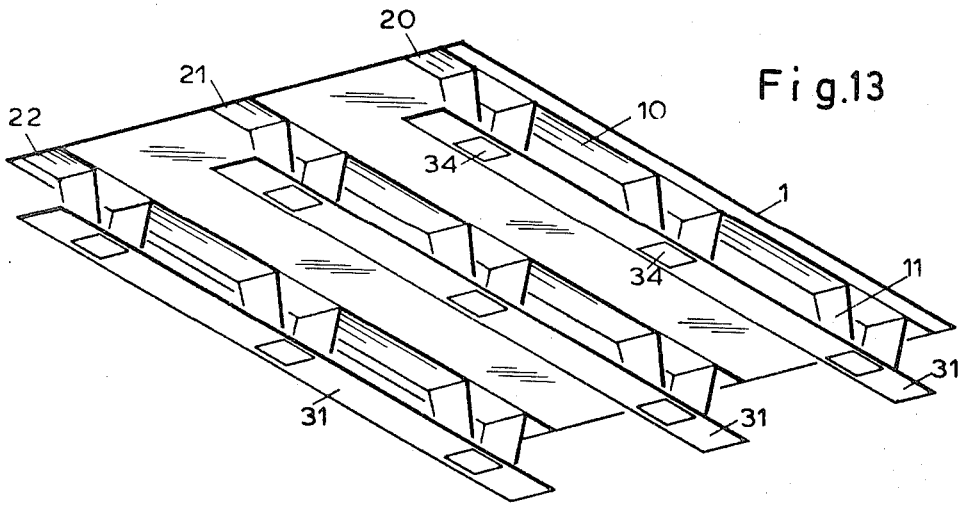
FIG. 13 is a bottom perspective view of an embodiment of a pallet according to the invention provided with bottom pieces.
Figure 14:
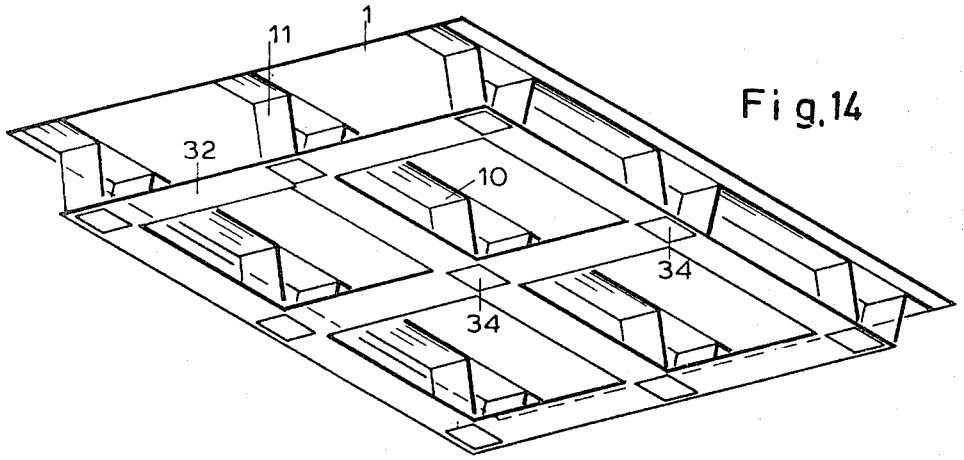
FIGS. 14 and 15 are views similar to that of FIG. 13 of embodiments of pallets according to the invention provided with bottom pieces.
Figure 15:
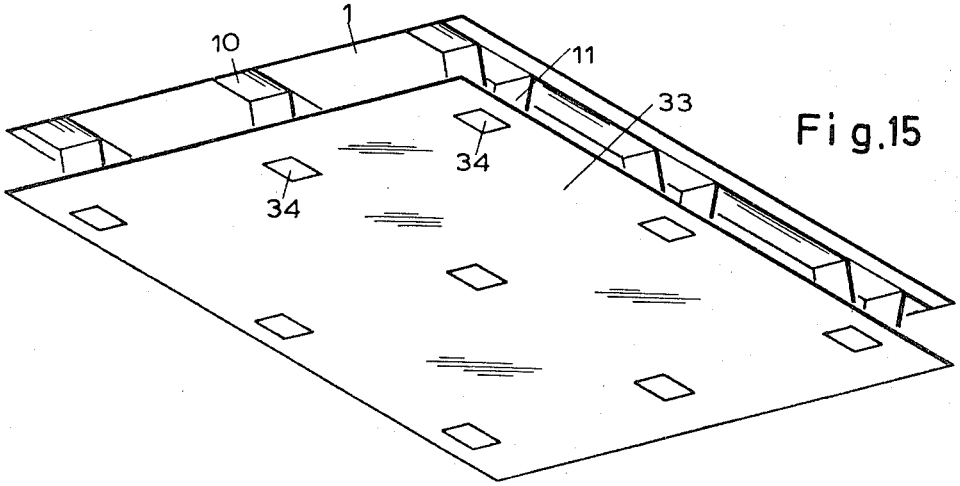

Examples of pallets having additional pieces attached are shown in FIGS. 13 to 15. In the flat pallet 1 shown in FIG. 13, continuous supporting runners 31 are fastened to the contact faces of the supporting feet 11 so as to extend along the same longitudinal rows 20, 21 and 22 as strips 10. The supporting runners 31 are preferably commercially available skid-profile sheet metal components. Alternatively, they may be preshaped or additionally shaped pallet runners.

Figure 25:
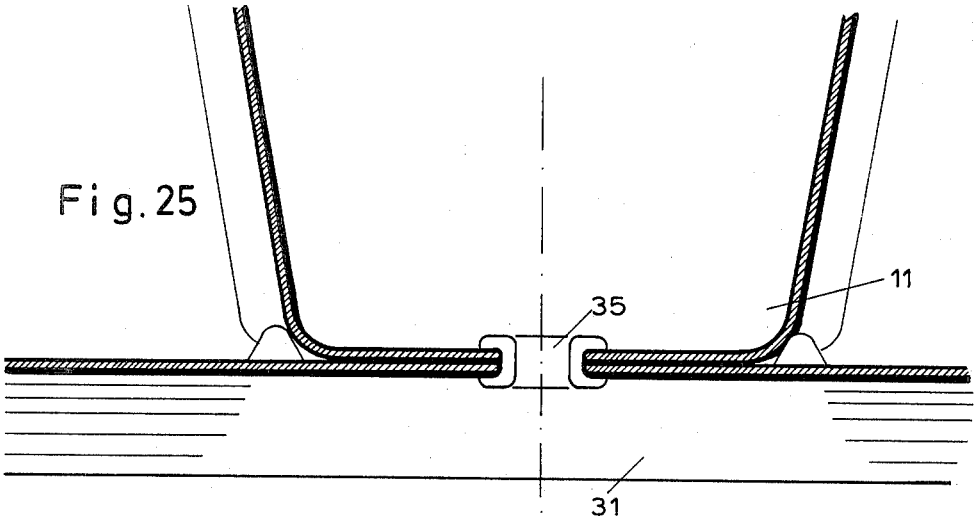
FIGS. 25–27 are side elevational, end elevational and plan views, respectively, of a connection zone for the embodiment of FIG. 13.
Figure 26:
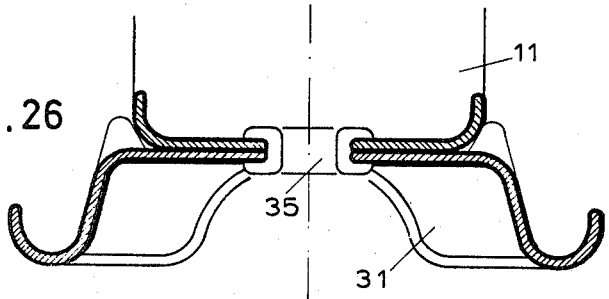
Figure 27:
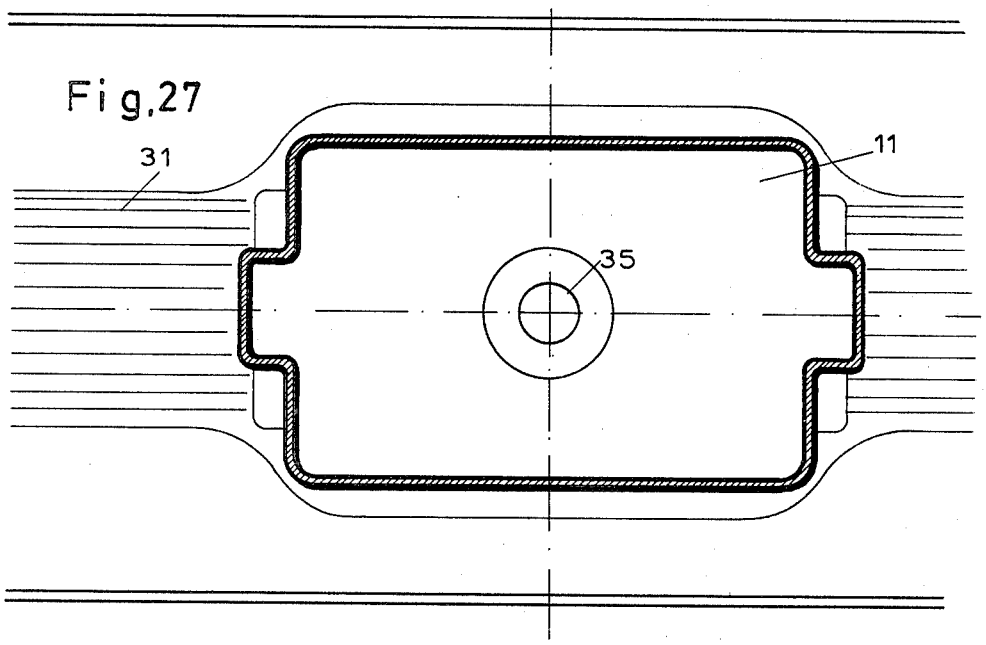

One embodiment of a runner 34 is shown in cross section in FIGS. 25, 26 and 27, FIG. 25 being a side elevation, FIG. 26 being a front elevation, and FIG. 27 being a plan view. As can there be seen, each runner can be attached to the standing areas of the feet of its associated strip 10 by means of large-caliber pop rivets 35, or removable clips can be used, the sheet metal strips being of the type as shown in any one of FIGS. 1 through 9, 11 and 12.

In each region 34 where a runner 31 is attached to a foot 11, the runner is provided, for example by a deep drawing operation, with a modified form, which is apparent from FIGS. 25–27, presenting an enlarged area of contact with the bottom of its associated foot 11. The unmodified form of each runner 31 is apparent particularly from the unhatched portion of FIG. 26. This additional shaping of the runners produces an arresting contact face for the standing areas of the supporting feet. The plane of this contact area lies at such a height that the supporting runners 31 will not interfere with the free insertion height of a lifting fork.

The edges of the supporting feet 11, 27, built as a part of the metal strips 10, 26, may be cured upwardly in order to improve their sliding effect.

In the embodiment shown in FIG. 14 a grid-like carrying frame 32 is fastened to the contact faces of supporting feet 11, also in the manner shown in FIGS. 25–27. The carrying frame 32 can be formed of sections of the carrying skids 31 shown, and described in connection with, FIG. 13.

In the embodiment shown in FIG. 15, a second deck 33 is provided at the contact faces of supporting feet 11. In this embodiment no recesses are required for the supporting feet. Instead, the additional deformations described in connection with FIG. 13 come into use in the region of the deep-drawn zones.

When the additional deck 33 is fastened to the supporting feet 11, a double decker pallet results whose deck 1 may alternate as a supporting or standing surface. Double decker pallets are used in the chemical industry and in breweries.

In the region of fastening to a supporting foot 11, an upwardly deep-drawn zone 34 is provided in the supporting runner 31, the carrying frame 32 or the deck 33.

It will be understood that the above description of the present invention is susceptible to various modifications, changes and adaptations, and the same are intended to be comprehended within the meaning and range of equivalents of the appended claims.

What is claimed is:

1. A stackable flat pallet comprising means defining a sheet metal supporting deck and means defining sheet metal supporting feet connected to said deck, said deck being provided with a plurality of openings each located in line with a respective supporting foot and configured to correspond to the outline of its associated foot, said deck further being provided with corrugations distributed over its surface and with a folded-over edge, each of said supporting feet having a tapered, skid-like configuration and being formed, together with its associated opening in said deck, to define a cavity for receiving the correspondingly located supporting foot of a comparable pallet for stacking, and means defining horizontal flanges connected to said feet, and fastened to said deck, wherein said supporting feet and said flanges are arranged in a plurality of rows with a respective flange disposed between successive feet in each such row, said feet and flanges of each such row are together constituted by a respecfive uniform, shaped sheet metal strip, and the ends of said sheet metal strip are secured by being held in the folded-over edge of said deck.

2. An article as defined in claim 1 wherein said sheet metal strips include a pluarlity of strips extending parallel to one another in a first direction and defining a plurality of rows of feet transverse to the first direction, and a further strip extending transversely to the first direction and defining in part one of the rows of feet.

3. An article as defined in claim 2 wherein said further strip presents flanges only in regions between supporting feet.

4. An article as defined in claim 1 wherein said sheet metal strips include a plurality of strips extending parallel to one another in a first direction and defining a plurality of rows of feet transverse to the first direction, and a further strip extending transversely to the first direction in a region between transverse rows.

5. An article as defined in claim 1 wherein said supporting deck comprises a closed frame and a plurality of crossed over, spaced, undeformed further sheet metal strips which are secured at their ends to said frame, intersect said sheet metal strips which constitute feet and flanges, and are connected thereto at the points of intersection.

6. An article as defined in claim 1 wherein at least part of said deck and part of said flanges are, at a point where the are fastened together, made of materials having respectively different strengths and are fastened together by providing the lower strength material with a bore and the higher strength material with a region where it is punched out, pulled through the bore and bent over the bore edge.

7. An article as defined in claim 1 wherein each of said strips is provided with longitudinal corrugations which are convex toward the bottoms of said feet.

8. An article as defined in claim 7 wherein said corrugations in said strips are disposed in the flange defining regions thereof and said supporting deck is provided with corrugations which are convex away from the bottoms of said feet and which are aligned with said corrugations in said flange defining regions of said strips.

9. An article as defined in claim 1 further comprising supporting runners extending parallel to said metal strips and each fastened to the bottoms of said feet defined by a respective strip.

10. An article as defined in claim 9 wherein each said runner is provided, in the region where it is fastened to a respective foot, with an upwardly deep-drawn zone providing an enlarged surface of contact with said respective foot.

11. An article as defined in claim 1 further comprising means defining a second supporting deck fastened to the bottoms of said feet.

12. An article as defined in claim 11 wherein said second deck is provided, in each region where it is fastened to a respective foot, with an upwardly deep-drawn zone providing an enlarged surface of contact with said respective foot.

* * * * *